United States Patent [19]

George

[11] Patent Number: 4,544,034

[45] Date of Patent: Oct. 1, 1985

[54] ACTUATION OF A GUN FIRING HEAD

[75] Inventor: Flint R. George, Katy, Tex.

[73] Assignee: GEO Vann, Inc., Houston, Tex.

[21] Appl. No.: 481,074

[22] Filed: Mar. 31, 1983

[51] Int. Cl.[4] ..... E21B 43/116

[52] U.S. Cl. ..... 166/297; 166/55.1; 175/4.52; 175/4.54

[58] Field of Search ..... 166/55, 55.1, 250, 264, 166/297, 298, 369, 370, 373, 374, 383; 175/4.54, 4.56, 4.52, 4.53, 4.58; 102/322, 204

[56] References Cited

U.S. PATENT DOCUMENTS

| | | | |
|---|---|---|---|
| 2,749,840 | 6/1956 | Babcock | 175/4.56 |
| 3,011,551 | 12/1961 | Young et al. | 166/297 |
| 3,040,808 | 6/1962 | Schramm et al. | 175/4.54 |
| 3,138,206 | 6/1964 | Bruce et al. | 166/55.1 |
| 3,185,224 | 5/1965 | Robinson, Jr. | 175/4.54 |
| 3,189,094 | 6/1965 | Hyde | 166/55.1 |
| 3,612,189 | 10/1971 | Brooks et al. | 175/4.54 |
| 3,706,344 | 12/1972 | Vann | 166/297 |
| 3,800,705 | 4/1974 | Tamplen | 175/4.54 |

*Primary Examiner*—James A. Leppink
*Assistant Examiner*—Hoang E. Dang

[57] ABSTRACT

The method and apparatus for actuating a perforating gun by pressure includes a pressure actuated gun firing head disposed on the perforating gun for detonating the shaped charges of the gun. The gun is attached to a pipe string and located downhole adjacent the formation to be perforated. The pressure actuated firing head includes a housing with a plug and piston. The piston has a firing pin adapted for engagement with the initiator of a perforating gun upon reciprocation within the housing. Initially, the piston is pressure balanced until the time of actuation. The plug is responsive to fluid pressure of a predetermined magnitude at the time of the actuation of the gun firing head. Upon effecting pressure on the plug, the plug unbalances the piston causing the piston to reciprocate. Upon reciprocation of the piston, the firing pin engages the initiator to detonate the shaped charges of the perforating gun. Pressure may be effected on the firing head through the pipe string, or the annulus, or both. The firing head includes a plurality of passageways, as well as the plug and piston, arranged in a manner whereby should leakage of well fluids into the firing head inadvertently occur, the apparatus is rendered inoperative and therefore the firing head cannot inadvertently be fired due to the occurrence of unforeseen intervening circumstances.

18 Claims, 10 Drawing Figures

ACTUATION OF A GUN FIRING HEAD

BACKGROUND OF THE INVENTION

After a wellbore has been formed into the ground and the casing has been cemented into place, the hydrocarbon containing zone usually is communicated with the casing interior by forming a plurality of perforations through the casing which extend radially away from the casing and out into the formation, thereby communicating the hydrocarbon producing zone with the interior of the casing.

It is common practice to run a jet perforating gun downhole and to fire the gun by the employment of a gun firing head which is actuated by a bar dropped down through the interior of the tubing string. Completion techniques involving this known completion process are set forth in U.S. Pat. Nos. 3,706,344 and 4,009,757.

A bar actuated firing head cannot be used in certain situations and sometimes it is desirable to be able to detonate the charges of a perforating gun without the use of a bar. Particularly it would be advantageous to actuate the gun by effecting a pressure within the pipe string or annulus or both, but a gun firing head which could be detonated in response to pressure effected within the borehole has been considered to be highly dangerous by many logging and completion engineers for the reason that leakage across some of the critical seals of the firing head could inadvertently detonate the firing head and prematurely explode the shaped charges of the gun. Should this misfire occur at an inappropriate time, untold damage could be done to the wellbore if, for example, the explosion occurred while running the gun into the hole, or if the explosion occurred before proper flow passsageways back to the surface had been provided for the completed formation. If a pressure actuated gun is to be safe, it is necessary that the firing head be unable to detonate the shaped charges until the gun has been lowered downhold and properly located relative to the formation to be completed.

U.S. Pat. No. 3,189,094 to Hyde discloses a hydraulically operated firing apparatus on a gun perforator for purposes of formation testing. The firing apparatus assembly includes a tubing string having a conventional formation tester valve in a housing and a conventional packer secured below the housing. Firing apparatus housings, along with the gun perforator, are series connected to the tubing string below the packer. In conducting a formation test, the assembly is lowered into a fluid filled wellbore so that, externally, all parts of the assembly are subjected to the submergence pressure exerted by the fluid in the well. The formations tester valve is initially closed so that the pressure within the empty tubing string is essentially at atmospheric pressure. When the packer is set, the zone opposite the gun is isolated from the region above the packer. Thereafter, when the formation tester valve is opened, the zone opposite the gun is exposed essentially to atmospheric pressure, or at least to a pressure which is greatly lower than the submergence pressure of the fluid in the well. Although various embodiments of the firing apparatus are disclosed, all of the embodiments utilize the submergence pressure to arm the firing apparatus during descent of the assembly and then utilize the low pressure condition created when the packer has been set and the formation tester valve opens to cause a pressure differential which operates the firing apparatus and fires the gun. The gun perforator penetrates the surrounding formation so that the formation fluids flow into the tubing string to complete the formation testing operation.

The present invention overcomes the deficiencies of the prior art.

SUMMARY OF THE INVENTION

According to the invention there is provided a pressure actuated firing head for detonating the shaped charges of a perforating gun to which the head is connected. The gun is suspended downhold in a borehole on a tubing string,, and the firing head is in fluid communication with the surface so that pressure can be effected at the surface down to the firing head to detonate the gun. The firing head is set to detonate the shaped charges of the gun at a predetermined pressure.

The pressure is elevated to a predetermined value, thereby moving a plug located in the head in response to the pressure. This action closes ports located in a piston of the head, whereby pressure can now be effected on the upper face of the piston, thereby driving the piston into engagement with an explosive initiator. The initiator, when detonated by the piston movement, causes the shaped charges of the gun to be detonated.

Prior to movement of the plug, the flow path from the surface to an upper chamber, located above the piston, is closed, and the ports through the piston into a lower chamber, located between the piston and the initiator, are open. Should leakage of well fluids into the upper chamber of the firing head inadvertently occur, the apparatus is rendered inoperative because the leaking fluid flows through the ports of the piston to the lower chamber so that equal fluid pressure is placed on opposed faces of the piston, thereby rendering the piston immovable and nonresponsive to pressure.

In a more specific embodiment of the invention, the firing head includes an elongated main housing having a passageway which is in fluid communication with a flow path to the surface.

A relatively small inside diameter length of the passageway is spaced from a relatively large inside diameter length thereof. A relatively small outside diameter plug in the form of a piston or plunger, is reciprocatingly received in sealed relationship within the relatively small inside diameter length of the passageway. A relatively large outside diameter piston is reciprocatingly received in sealed relationship within the relatively large inside diameter length of the passageway.

A firing pin is connected at the lower end of the piston, and the explosive initiator underlies the firing pin and is adapted to explode when struck by the firing pin. The lower chamber is formed below the piston.

An upwardly opening aperture is formed in the piston for sealingly receiving a marginal end of the small outside diameter plug therewithin. The upper chamber is formed above the piston and a flow path extends from the upper chamber, through the piston aperture and ports, and into the lower chamber. The upper chamber is in communication with both the plug and piston. The lower chamber is in communication with both the initiator and the piston. A flow path extends from the surface, into the small inside diameter length of the passageway to put pressure on the plug. Spaced seals are placed about the plug to preclude flow from the surface into the upper chamber.

In one embodiment of the invention, a bore extends from near the upper end of the plug, through the plug, and into the upper chamber above the piston to equalize pressure around the plug should seals leak around a stem connected to and extending from the upper end of the plug.

The stem extends upwardly to a location above the upper end of the passageway where the stem is in fluid communication with the surface and the upper end of the stem is exposed to pressure from the surface. Upon application of a predetermined pressure from the surface, the pressure forces the plug to move downhole into sealed engagement with the aperture of the piston. Movement of the plug opens fluid communication with the upper chamber and therefore the piston so that pressure can be effected within the upper end of the passageway and upper chamber, and the piston forced to move downwardly thereby causing the firing pin to strike the initiator and fire the shaped charges of the jet perforating gun.

Accordingly, pressure can be effected downhole from the surface to initiate the first step required to actuate the gun firing head. This moves the plug into the aperture of the piston, thereby sealing the piston against flow therethrough. This action also forms a flow path by which pressure effected from the surface is also effected on the upper face of the piston. The pressure differential across the plug and piston drives the piston downhole, causing the firing pin to engage and detonate the initiator.

Also, should it be desirable and conditions permit, a bar may be dropped down the pipe string to engage the upper end of the stem to move the plug and piston downwardly to activate the gun.

Should leakage occur into the area above the piston, it becomes impossible to fire the gun because pressure across the piston is equalized, and since there is no pressure differential, the piston cannot be forced downwardly.

Accordingly, a primary object of the present invention is the provision of a fail safe, pressure actuated firing head for a perforating gun which detonates the gun in response to a predetermined pressure being effected from the surface.

Another object of the present invention is the provision of a pressure actuated firing head which can be actuated by using only pressure from the surface, or by a combination of a bar and the employment of hydraulic pressure.

A still further object of the present invention is the provision of a pressure actuated firing head where a bar may be dropped through a tubing string to impact the stem to partially actuate the head, and thereafter pressure is utilized to detonate the shaped charges.

A further object of the present invention is the provision of a pressure actuated firing head for detonating the shaped charges of a perforating gun which will not explode should leakage of well fluid into the apparatus inadvertently occur.

Another and still further object of the present invention is the provision of a method of detonating the shaped charges of a perforating gun which has a fail safe provision whereby leakage of well fluid into the gun head renders the apparatus inoperative.

An additional object of the present invention is the provision of a method of detonating the shaped charges of a perforating gun by using pressure to move a plug into sealed engagement with a piston and thereafter exposing the piston to the pressure to move the piston into engagement with an explosive device so that the explosive device detonates the shaped charges of the perforating gun.

A still further object of this invention is the provision of a method of perforating of hydrocarbon containing formation located downhole in a cased borehole by the provision of a pressure actuated gun firing head attached between a gun and the end of the tubing string, and wherein the gun firing head is set to detonate the shaped charges of the gun at a predetermined pressure, and wherein the pressure is selected in accordance with the anticipated downhole formation pressure.

Another and still further object of the present invention is the provision of a method of perforating a pay zone located downhole in a borehole by elevating the downhole pressure to a predetermined value, dropping a bar down the tubing string, whereupon the act of arresting the bar is used to move a plug in order to seal an aperture located in a piston, and thereafter the pressure forces the plug and piston to move into engagement with an initiator which detonates the shaped charges of the perforating gun.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENTS

Figure 1:
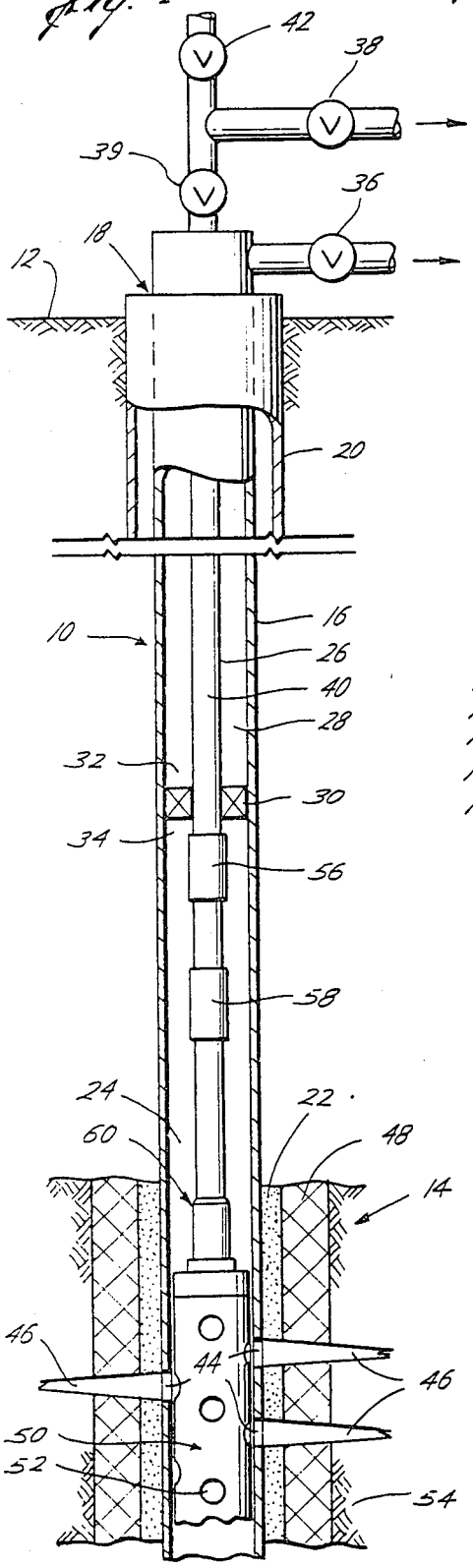
FIG. 1 is a fragmentary, partly schematic, partly diagrammatic, partly cross-sectional view of a well with a substantially vertical borehole and an apparatus made in accordance with the present invention associated therewith.

Referring initially to FIG. 1, there is disclosed a typical well having borehole 10 extending downhole from the surface 12 of the ground through a hydrocarbon-containing formation 14. The borehole 10 is cased by a string of casing 16 hung from wellhead 18 and within surface casing 20. Casing string 16 is cemented into borehole 19 and casing 20 as shown at 22. Casing 16 isolates the wellbore 24 from formation 14. A string of production tubing 26 is suspended within casing 16 and extends from the surface 12 axially through casing 16. Tubing 26 within casing 16 forms borehole annulus 28, and packer 30, disposed on tubing 26, divides the borehole annulus 28 into an upper annulus 32 and a lower annulus 34. Suitable outlets are provided at the surface 12 for the tubing flow bore and each annulus formed by adjacent casing strings with each of the outlets being provided with suitable valves and the like, including valve 36 for the outlet communicating with the borehole annulus 28 and valves 38, 39 for the outlet communicating with the flow bore 40 of tubing string 26. A lubricator 42 is provided for access to tubing flow bore 40 for the use of slick line tools.

In order to complete the well or test the formation, it is necessary to access the hydrocarbons in formation 14 with the wellbore 24. This is accomplished by supporting a perforating gun 50 at the lower end of the tubing string 26. Gun 50 is preferably a jet casing gun, but it should be understood that the term is intended to include any means for communicating the hycrocarbon-producing formation 14 with lower annulus 34. The jet perforating gun of the casing type shoots metallic particles into the formation 14 to form perforations 44 and corresponding channels or tunnels 46. Numerals 44 and 46 broadly indicate a few of a plurality of perforations and tunnels which are formed when the charges 52 of gun 50 are detonated. Perforating objectives include perforations of a desired size and configuration, prevention of further formation invasion and contamination during the perforating process, and maximum capacity to move the hydrocarbons from formation 14 to lower annulus 34.

During the drilling of the borehole 10, the formation pressures are controlled by weighted drilling fluid, filtrate and perhaps fines which invade the formation, interacting with in situ solids and fluids to create a contaminated zone 48, reducing permeability, and leaving on the face of formation 14 a low-permeability filter cake. The cementing operation also includes fluids and fines which invade and damage the formation 14 at the contaminated zone 48. Thus, the jet perforating gun 50 of the casing type using shaped charges 52 must penetrate deeply into the formation 14 to form tunnels 46 that pass through casing 16, cement 22, and contaminated zone 48 and into the uncontaminated or sterile zone 54 of formation 14. Perforations 44 and tunnels 46 form the final passageways which enable the hydrocarbons to flow from the formation 14, through tunnels 46 and perforations 44 and into lower annulus 34 for movement to the surface 12.

Various tool strings may be included with tubing string 26, packer 30, and gun 50 to complete the well and/or test the formation. FIG. 1 illustrates one variation of a tool string to complete the well and transport the hydrocarbons contained in formation 14 to the surface. As shown, the tool string includes tubing string 26, a perforated nipple or vent assembly 56, a releasable coupling device 58, packer 30, a pressure actuated firing head 60 in accordance with the present invention, and casing perforating gun 50.

Vent assembly 56 is located in underlying relationship relative to packer 30 and made of the designs described in U.S. Pat. Nos. 4,151,830; 4,040,485 and 3,871,448. Although not essential, it is sometimes desirable to include a releasable coupling 58, such as described in U.S. Pat. No. 3,966,236, to release gun 50 after detonation.

Perforating gun 50, such as disclosed in U.S. Pat. Nos. 3,706,344 or 4,140,180, is connected to the lower end of tubing string 26 and includes shaped charges 52 of known design, which, when detonated, form perforations 44 through the sidewall of casing 16 and form tunnels 46 which extend radially from borehole 10 and back up into the sterile zone 54 of formation 14.

Figure 9:
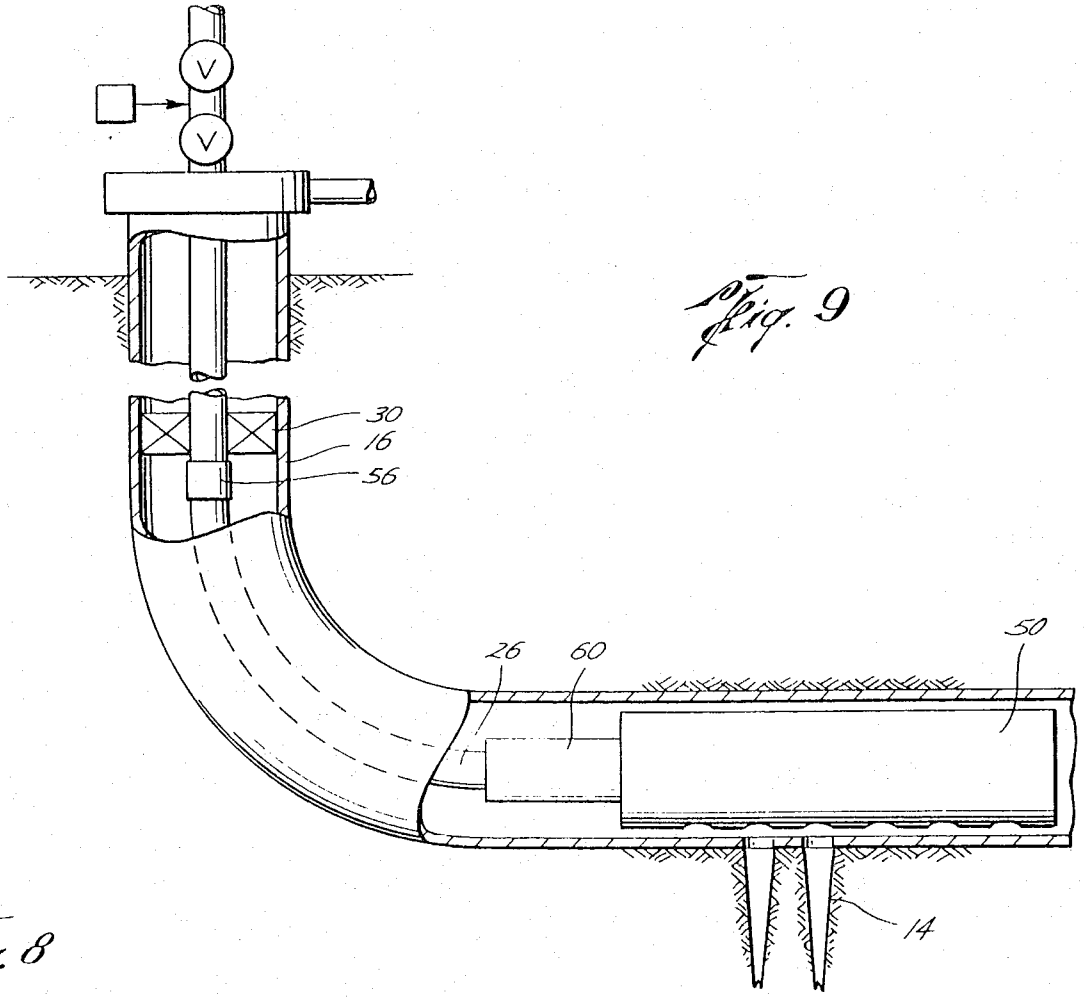
FIG. 9 is a fragmentary, partly schematic, partly diagrammatic, partly cross-sectional view of a highly deviated well and an apparatus made in accordance with the present invention associated therewith.

In the tool string shown in FIG. 1, pressure firing head 60 forms the upper end of perforating gun 50. Pressure actuated firing head 60 connects the housing or charge carrier of gun 50 to the lower end of tubing string 26; and, tubing string 26, casing 16, packer 30, vent assembly 56, releasable coupling 58, gun firing head 60, and jet firing gun 50 are all more or less arranged along a common axial centerline. In some instances, borehole 10 may be deviated, or slanted almost back to the horizontal as shown in FIG. 9, and in that instance, the apparatus of the tool string may instead be eccentrically arranged relative to one another. This invention can therefore be used in vertical as well as slanted boreholes and is especially adapted for use where difficulty is experienced in actuating the gun firing head, as for example in instances where a bar cannot be gravitated downhole, or where a slick line cannot be used in conjunction with a bar or fishing tool in order to detonate the gun firing head by impact.

Although various methods of operation will be hereinafter set forth, briefly, the well is typically completed by setting packer 30 and opening vent assembly 56, pressurizing the fluid in flow bore 40 of tubing string 26 to actuate firing head 60, detonating gun 50, perforating formation 14, and flowing hydrocarbons into the lower annulus 34, through open vent assembly 56, and up tubing flow bore 40 to the outlet valve 38.

Figure 2:
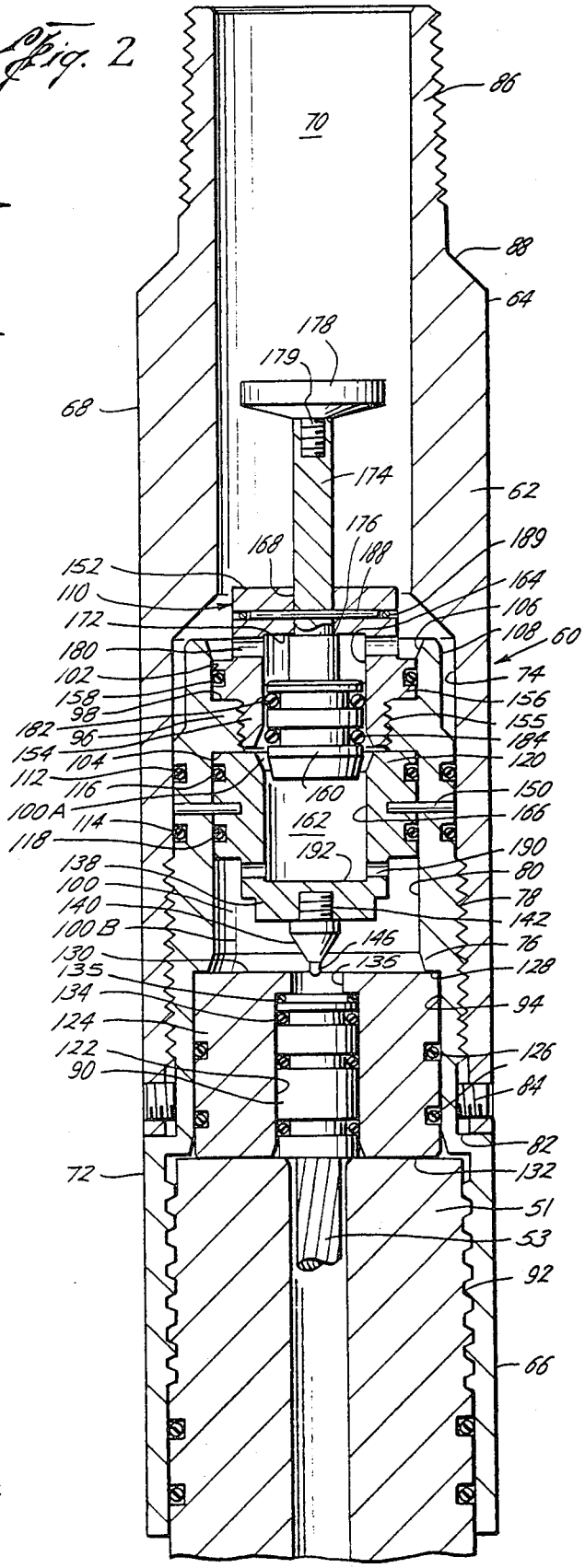
FIG. 2 is an enlarged cross-sectional view of part of the apparatus disclosed in FIG. 1 prior to actuation.

Referring now to FIG. 2 for a description of one embodiment of the present invention, the pressure actuated firing head 60 includes a tubular housing 62 composed of an upper cylinder 64 and a lower mandrel 66. Cylinder 64 has an outer cylindrical surface 68 which is of the same diameter as the outer cylindrical surface 72 of mandrel 66. An axial fluid passageway 70 extends the length of cylinder 64 and includes a counterbore forming box 74 at the lower end thereof. Reference to "lower" and "upper" parts of the present invention refers to their position shown on the drawings attached hereto for convenience and does not necessarily indicate their position during actual operation. Although firing head 60 is shown positioned in one direction in the well as shown in FIG. 1, head 60 is positioned in the opposite direction as shown in FIG. 11. Thus references to "lower" or "upper" are not to be limiting.

Mandrel 66 includes a reduced diameter portion or pin 76 which is telescopingly received within box 74 of cylinder 64. Pin 76 is threadingly engaged to box 74 at 78 by external threads on pin 76 and internal threads on box 74. Pin 76 forms an annular shoulder 82 for seating the lower end of cylinder 64 upon complete attachment.

Set screws 84 are provided in threaded bores in the lower end of cylinder 64 to engage the outer surface of pin 76 and prevent any inadvertent disengagement of cylinder 64 and mandrel 66. Pin 76 has annular seal grooves in which are disposed sealing members 112, 114 for sealing engagement with the internal surface of box 74 to prevent leakage at connection 78.

At the upper end of cylinder 64 is a tapered threaded pin 86 and tapered shoulder 88 for making connection with one of the pipe members making up tubing string 26. The pipe member of string 26 adjacent pin 86 has a threaded box which threadingly receives pin 86 for mounting firing head 60 onto tubing string 26. Pipe readily available at the well site is often used for tubing string 26. Since that pipe may often be drill pipe or drill collars, the connection on the upper end of housing 62 may be a rotary shouldered connection compatible with such pipe.

Mandrel 66 includes a lower threaded box end 92 for threadingly receiving a sub 51 on the upper end of perforating gun 50. Pin 76, extending above box end 92, has a central bore 80 generally having the same internal diameter as axial passageway 70 in cylinder 64. Central bore 80 has a lower counterbore 94 adjacent box end 92 for receiving initiator 90 as hereinafter described, and is restricted by an inwardly directed annular shoulder 96 located near the upper end of pin 76. Annular shoulder 96 includes an upwardly facing seat 98 forming an insert counterbore 102 with the upper portion of bore 80 and a downwardly facing seat 104 forming a chamber 100 with the lower portion of bore 80. Insert counterbore 102 receives closure assembly 110, hereinafter described, and chamber 100 houses piston 120, hereinafter described. The upper end of bore 80 is bevelled at 106 for receiving closure assembly 110, and pin 76 is reduced in outer diameter at 108 along its upper end.

Piston 120 is slidingly received by chamber 100 for reciprocation therein and has annular grooves housing upper and lower O-ring seals 116, 118, respectively, for sealing engagement with the internal cylindrical surface of chamber 100.

Initiator 90 is mounted within a bore 122 in an initiator support 124 which is telescopingly received within lower counterbore 94 of central bore 80. Support 124 has O-rings 126 disposed an annular grooves therearound for sealing with the internal surface forming counterbore 94. Counterbore 94 and bore 80 form a downwardly facing annular shoulder 128 for abutting the upper face 130 of support 124. As the sub 51 of perforating gun 50 is threaded into box end 92, the upper end of the sub 51 engages the lower face 132 of support 124 and the lower end of initiator 90 to secure support 124 and initiator 90 within lower counterbore 94. Initiator 90 supports a plurality of seal rings 134 on its exterior for sealing engagement with the inner surface of bore 122 and has an elastomeric ring 135 on its upper end to take up any end play as sub 51 is threaded into end 92. A prima cord 53 extends from initiator 90 to the shaped charge 52 of gun 50 whereby upon the initiation of initiator 90, charges 52 are detonated. The upper end of bore 122 is reduced in diameter forming an entry bore 136 for a firing pin to be described.

Piston 120 includes a reduced diameter lower end 138 which supports a firing pin 140 positioned on piston 120 to be received by entry bore 136 when piston 120 is moved to its lowermost position. Firing pin 140 has threads on one end which is threaded into a hole at 142 in the lower face of end 138 and secured by a set screw (not shown), and a point 146 for impacting and setting off initiator 90. As best shown in FIG. 2, initially piston 120 is secured by shear pins 150 in an uppermost position against lower seat 104 in chamber 100. Shear pins 150 are sized to shear upon the application of a predetermined pressure force on the upper face of piston 120.

Closure assembly 110 is mounted on pin 76 to open and close fluid communication with chamber 100. Assembly 110 includes a generally cylindrical bonnet 152 having a lower threaded end 154 and an outwardly extending radial annular flange 156. The aperture through annular shoulder 96 of pin 76 is threaded to threadingly engage at 155 end 154 and secured closure assembly 110 to the upper end of pin 76. Annular flange 156 is slidingly received by insert counterbore 102 and includes an O-ring seal 158 received in an annular groove in the radial circumference of shoulder 156 to seal with the internal wall forming insert counterbore 102.

Closure assembly 110 further includes a piston member or a plunger or a plug 160 reciprocably received in a cylinder 162 formed by cooperating blind bores 164, 166 in bonnet 152 and piston 120, respectively, having a common inner diameter. Each mouth of blind bores 164, 166 is conically tapered for ease of passage of plug 160 between bores 164, 166. Bonnet bore 164, as shown, opens downwardly opposite the upwardly facing open end of piston bore 166. The bottom 172 of bonnet blind bore 164 has a hole 168 for slidably receiving a shaft or stem 174 on plug 160 extending upwardly therethrough. Stem 174 has a stop shoulder 176 which engages bottom 172 to limit the upward movement of plug 160 within bonnet bore 164. A stem head 178 may be threaded at 179 onto the uppermost end of stem 174 where auxiliary bar actuation of head 60 may be desirable. The piston portion of plug 160 has annular grooves therearound in which are housed O-ring seal members 182, 184 for sealingly engaging the cylindrical walls of cylinder 162 as plug 160 reciprocates therein.

Bonnet bore 164 is part of a fluid flow path which ultimately extends to the surface 12. A plurality of radial fluid ports 180, located adjacent bottom 172 of bonnet bore 164, extend from blind bore 164 to the exterior of bonnet 152 and axial fluid flow passageway 70 of cylinder 64. Shoulder 176 of stem 174 prevents plug 160 from moving over bonnet ports 180 so as to damage O-ring seal members 182, 184. Initially, as shown in FIG. 2, plug 160 is in the upper and bonnet port sealing position preventing any fluid flow from passageway 70 to chamber 100. Plug 160 is held in the upper position by shear pin 188 sized to shear upon the application of a predetermined fluid pressure in passageway 70 through bonnet ports 180 and that portion of bonnet bore 164 above plug 160. Roll pins 189 pass through closure assembly 110 to hold shear pin 188 in position.

Shear pins 188 determine the amount of fluid pressure required in passageway 70 to actuate firing head 60. Where head 60 is to be actuated solely by fluid pressure, i.e. without the use of a bar, shear pins 188 are sized to shear at a predetermined pressure approximately 2000 to 3000 psi above hydrostatic pressure. The hydrostatic pressure is the heavier of the hydrostatic head in the casing annulus 28 or the tubing flow bore 40. If the predetermined pressure were calculated based on the tubing flow bore hydrostatic and the casing annulus hydrostatic was greater than the predetermined pressure set to shear pins 188, a leak from the casing annulus into the tubing flow bore might raise the fluid pressure in passageway 70 to the predetermined pressure and prematurely detonate gun 50. Thus, shear pins 188 must be heavy enough to insure that pin 188 will not be sheared by the largest hydrostatic head in the well.

Piston bore 166 also has a plurality of radial fluid ports 190 located adjacent the bottom 192 of piston bore 166 permitting fluid flow between that portion of chamber 100 above piston 120, i.e. upper chamber 100A, and that portion of chamber 100 below piston 120, i.e. lower chamber 100B. So long as piston ports 190 are open, the fluid pressures will be equal in upper and lower chambers 100A, 100B since ports 190 will permit equalizing flow therebetween. This flow pathway between chambers 100A, 100B provides a pressure balancing means across piston 120 to prevent the inadvertent and premature detonation of gun 50 due to a pressure buildup in upper chamber 100A. For example, if plug seals 182, 184 or bonnet seal 158 were to leak fluid from axial fluid passageway 70 into upper chamber 100A, such a pressure increase would merely equalize across piston 120 due to flow through piston ports 190 into lower chamber 100B.

Figure 3:
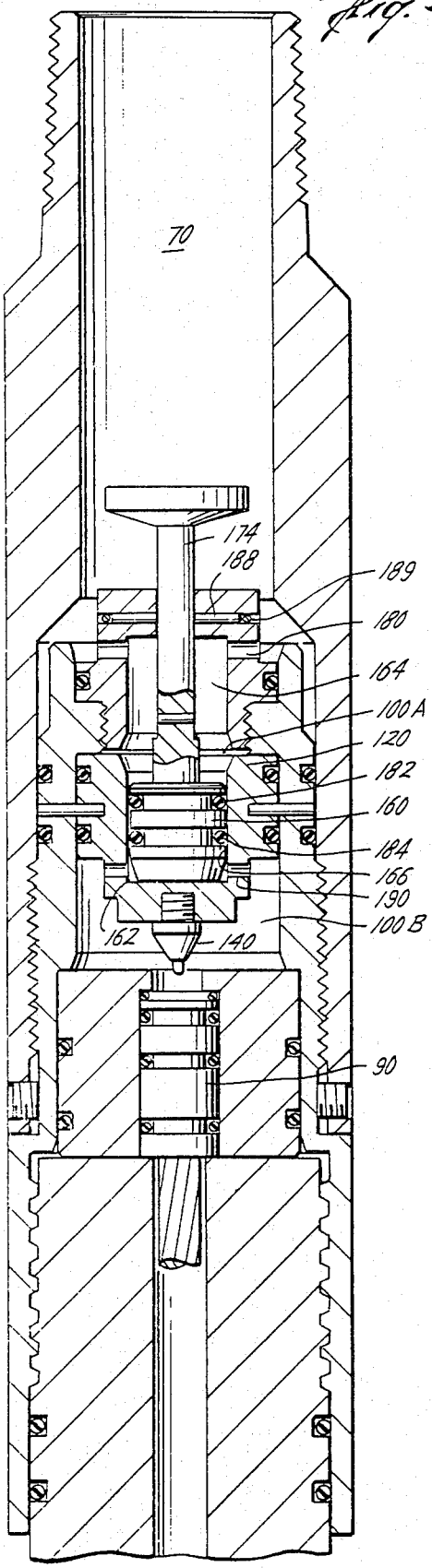
FIG. 3 is a cross-sectional view of the apparatus disclosed in FIG. 2 after partial actuation.

Referring now also to FIG. 3 showing partial actuation, shear pin 188 is sheared by increasing the fluid pressure in axial passageway 70 which, when applied to the cross-sectional area of stem 174 projecting into passageway 70 and to the remaining cross-sectional area of plug 160 in that portion of bonnet bore 164 above plug 160 via bonnet ports 180, the force will reach the predetermined amount which will shear pin 188. The pressure on plug 160 and stem 174 causes plug 160 to move downwardly in cylinder 162, passing from bonnet bore 164 where bonnet ports 180 are sealed to piston bore 166 where seal members 182, 184 of plug 160 sealingly engage the cylindrical wall of piston bore 166 and seal off piston ports 190.

Figure 4:
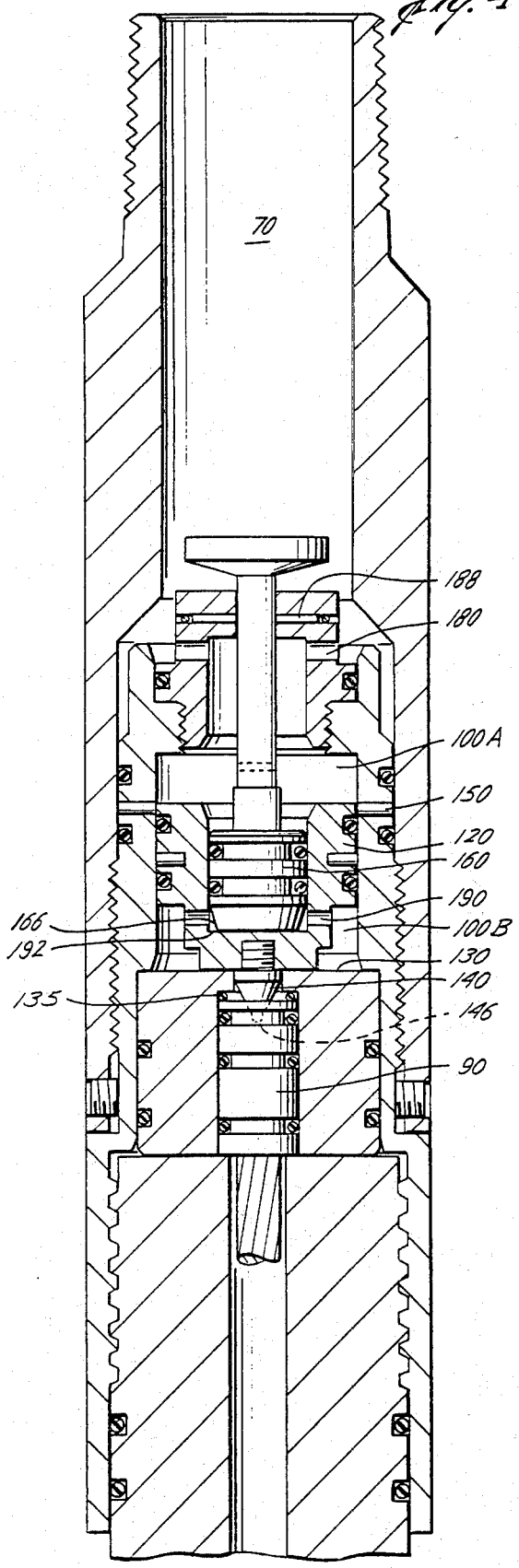
FIG. 4 is a cross-sectional view of the apparatus disclosed in FIG. 3 after full actuation and detonation of the perforating gun.

Referring now to FIG. 4, pressure actuated firing head 60 is shown fully actuated. By unsealing bonnet ports 180, the fluid from axial passageway 70 now flows into upper chamber 100A. Further, because plug 160 has now sealed piston ports 190, a pressure differential is effected across piston 120. Upon the application of this increased fluid pressure onto the upper face of piston 120 and the impact of plug 160 engaging bottom 192 of piston bore 166, pins 150 are sheared. Shear pins 150 for piston 120 may be larger than shear pins 188 for plug 160 because the cross-section of piston 120, i.e. pressure area, is greater than the cross-section of plug 160. Since piston 120 is substantially heavier than plug 120, pins 150 need to be larger to pass the drop test. Pins 150 are not strong enough to withstand the hydrostatic head and would shear.

Upon shearing pins 150, piston 120 moves downwardly in chamber 100 with the point 146 of firing pin 140 impacting initiator 90 to detonate charges 52 of perforating gun 50. Piston 120 snaps downwardly to provide a substantial impact of pin 140 with initiator 90. The lower face of piston 120 engages the upper face 130 of support 124 to arrest the downward movement of piston 120.

In operation, fluid pressure is effected into passageway 70 to actuate head 60. Although normally the fluid pressure will be hydraulic pressure from a liquid, it is possible that a gas may be used to actuate head 60. Further, fluid pressure may be effected in passageway 70 by pressuring down the flow bore 40 of tubing string 26, or pressuring down the casng annulus 28, or pressuring down both the tubing flow bore 40 and casing annulus 28, or pressuring down a flow path made up of portions of tubing flow bore 40 and casing annulus 28 to communicate with passageway 70.

The pressure effected into passageway 70 is hydrostatic pressure plus a safety margin pressure such as 20% of hydrostatic pressure or about 2000 to 3000 psi. Again the heaviest hydrostatic pressure in the well is used to calculate the predetermined pressure required to actuate firing head 60. Once the fluid pressure in passageway 70 exceeds the predetermined pressure limit for shear pins 188, pins 188 shear and free plug 160 to move downwardly.

A substantial pressure differential is created across plug 160. On the upper face of plug 160 and stem 174 is hydrostatic pressure plus 2000 to 3000 psi and on the lower face of plug 160 is atmospheric pressure since cylinder 162 and chamber 100 are at atmospheric. As plug 160 moves downward under the pressure differential, seal 182 continues to seal with bonnet 152 until after lower seal 184 has sealingly engaged the walls of cylinder 162 of piston 120. As plug 160 moves into cylinder 162, any trapped pressure is exhausted through piston ports 190. Once plug 160 is received within cylinder 162 and seal 184 has sealed with piston 120, ports 190 in piston 120 are closed preventing free fluid flow between upper and lower chambers 100A and 100B. At that time upper seal 182 disengages with bonnet 152 and permits the fluid pressure of passageway 70 to pass into upper chamber 100A and be applied to the cross-section of piston 120. Fluid from passageway 70 flows through hole 168 between stem 174 and bonnet 152 and through bonnet ports 180 into blind bore 164 in bonnet 152. The fluid then passes from bore 164 into upper chamber 100A.

Upon the application of the fluid pressure from passageway 70 to piston 120, a pressure differential is created across piston 120. The fluid pressure from passageway 70 is applied to the upper face of piston 120 and atmospheric pressure is on the lower face of piston 120 since lower chamber 100B is at atmospheric. This large pressure differential causes piston 120 to snap downwardly. The lower reduced diameter portion around piston 120 prevents any pressure lock as piston 120 moves downward to cause firing pin 140 to impact initiator 90.

The force of impact between pin 140 and initiator 90 ignites prima cord 53 which in turn detonates the shaped charges 52 of jet perforating gun 50. The formation 14 is perforated forming perforations 44 and tunnels 46 to permit the hydrocarbons of formation 14 to flow into annulus 28.

Figure 5:
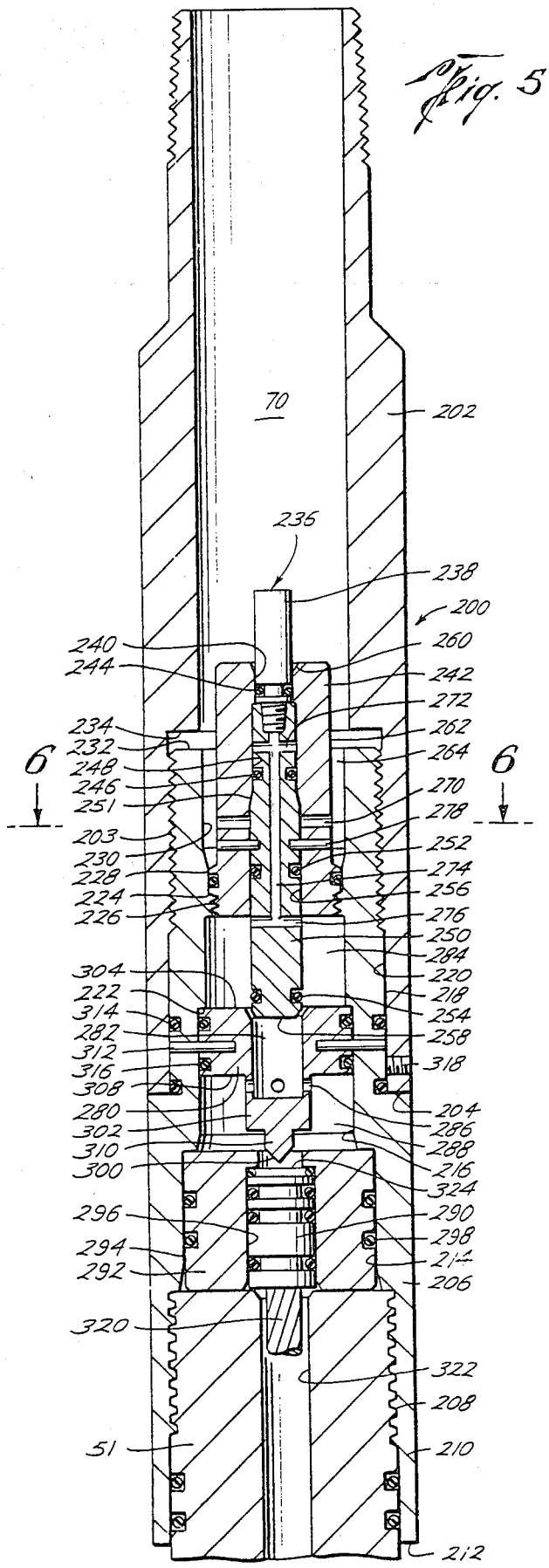
FIG. 5 is an enlarged cross-sectional view of another embodiment of the apparatus disclosed in FIGS. 2 through 4.
Figure 6:
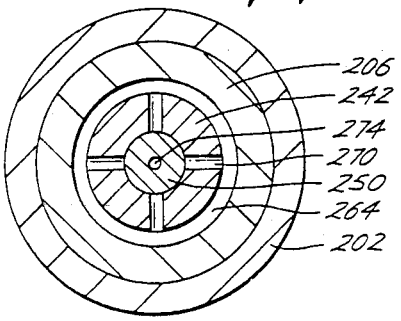
FIG. 6 is a cross-sectional view taken along line 6—6 of FIG. 5.

FIGS. 5–8 illustrate another embodiment of the present invention. Referring initially to FIGS. 5 and 6, the other embodiment of the pressure actuated gun firing head 200, as illustrated, is seen to include a main body composed of an upper main body part 202 substantially the same as cylinder 64 of the first embodiment including a cylindrical axial passageway 70 formed on the inside thereof, which enlarges in diameter into an internally threaded surface 203, and terminates in a circumferentially extending edge portion 204.

The main body includes a lower main body part 206 terminating in a female threaded interior surface 208, hereinafter also called "a box or a box end". The box end 210 has a circumferentially extending lower terminal edge portion 212.

The box end 210 includes an axial bore 214 which is reduced in diameter at 216. The outside diameter of the upper end of the lower main body part 206 is reduced in diameter commencing at 204 to provide reduced diameter part 218. Outer surface 218 and inner surface 220 are made in close fitting relationship relative to one another so that one slidably receives the other in a telescoping manner therewithin. The before mentioned coacting threaded areas 203 releasably fasten the upper and lower main body parts 202, 206 together.

An annular boss 224 projects inwardly from housing 200 and is internally threaded at 226. The boss 224 increases in diameter to provide a cylindrical portion 228, which again increases in inside diameter at 230 to provide the illustrated upper constant diameter inner surface which terminates at the upper terminal end thereof in the form of a shoulder 232.

The upper main body part 202 includes a shoulder 234 which is slightly spaced from the confronting shoulder 232. Axial passageway 70 is in communication with the interior of the tubing string 26. Trigger device 236 is positioned within the axial passageway 70 and includes a shaft 238.

Shaft 238 is slidably received in close tolerance relationship within a bore 240 in bushing 242. O-ring 244 seals the interface between the bore 240 and the shaft 238. Shaft 238 is screwed into the upper end of piston plug 250 which is of larger diameter than shaft 238. O-ring 246 seals the interface between the enlarged bore 248 and piston plug 250. The lower end of piston plug 250 is larger in diameter than the upper end providing a transition portion at 251. Circumferentially extending grooves on piston plug 250 house an upper O-ring 252 and a lower O-ring 254. O-ring 252 seals with further enlarged bore 256 of bushing 242. Numeral 258 indicates the lower terminal end of piston plug 250.

As best shown in FIG. 5, bushing 242 is secured to lower body part 206, and is provided with a contoured entrance at 260. Bushing 242 further includes an outer surface area defined by outside diameter 262. The bushing is spaced from the wall of axial bore 70, thereby forming an upwardly opening annulus 264. The annulus 264 communicates with bore 256 by means of the illustrated radial passageway 270. The upper reduced diameter end of piston plug 250 includes at least one radial passageway 272 which communicate with an axial passageway 274 which leads to a lower radial passageway 276. Radial passageway 276 communicates, via axial passageway 274, with the upper end of piston plug 250 which is isolated from well fluids by means of the spaced O-rings 244 and 246.

Should well fluids leak past seal 244 or 246 to act on the upper end of piston plug 250, it will also be conducted by passages 272, 274, 276 to lower end 258 of piston plug 250 and exert there a balancing force so that piston plug 250 will not be moved. The upper end of piston plug 250 is releasably affixed to bushing 242 by means of radially disposed shear pins 278. Shear pins 278 are selected to fail upon the application of a predetermined force, as will be more fully discussed hereinafter.

In this embodiment of the present invention, shear pins 278 may be somewhat smaller. Because that portion of bore 248 between seals 244, 246 communicates with upper chamber 284, via ports 272, 274, 276, there is atmospheric pressure on both sides of the small diameter portion of plug 250 having little tendency for moving plug 250. The only down force on plug 250 is the difference in cross-sectional area between the larger lower portion of piston 250 and the smaller upper portions of piston 250. Thus the smaller pins 278 can pin against a high hydrostatic.

Large piston 280 has an upwardly opening passageway 282 formed therewithin which is in communication with an upper chamber 284 when the firing head is in the standby configuration as shown in FIG. 5. Lateral ports 286 place the lower chamber 288 in communication with piston passageway 282.

Initiator support 292 underlies the piston 280 and has an outside diameter 294 fitting closely within the before mentioned axial bore 214. The support 292 is provided with an axial bore 296 which sealingly receives the initiator 290 in sealed relationship therewithin, noting the plurality of spaced O-rings located between the initiator 290 and the bore 296. O-rings 298 seal the interface between outside diameter 294 and axial bore 214. Piston 280 is reduced in diameter at lower end 302 thereof. The upper face 304 of piston 280 is disposed within the interior of chamber 284. Lower face 308 of piston 280 is disposed within lower chamber 288. The lower end of piston 280 is again reduced at 310 to provide a firing pin 300 at the lower extremity thereof.

Radial shear pins 312 are formed through the sidewall of the lower main part 206 and extend into bores formed in a sidewall of piston 280. Shear pins 312 are sized to insure that pins 312 do not shear due to the weight of piston 280 or due to head 60 being accidentally dropped. O-rings 314 seal against fluid flow across the shear pins 312 and across the threads 203. O-rings 316 further seal against flow which may occur across shear pins 312 or from upper chamber 284 into lower chamber 288 under certain conditions of operation, as will be further discussed later on in this disclosure.

Locking screws 318 prevent inadvertent relative motion between the upper and lower main body parts 202 and 206. Prima cord 320 is routed through passageway 322 of sub 51 associated with gun 50. The prima cord 320 is attached to the initiator 290, and to the shaped charges 52 so that when the firing pin 300 strikes face 324 of initiator 290, initiator 290 explodes, which in turn explodes prima cord 320, and this action instantaneously detonates all of the shaped charges 52 associated with the gun 50. In actual practice, the initiator explodes and thereafter the prima cord 320 is progressively exploded, with each of the shaped charges 52 being sequentially exploded; however, the time frame within which this explosive train occurs is of such a short duration that one could call this action "instantaneous", although those skilled in the art of measuring phenomena that occur within a millisecond would probably consider that the explosion train requires a time duration.

Figure 7:
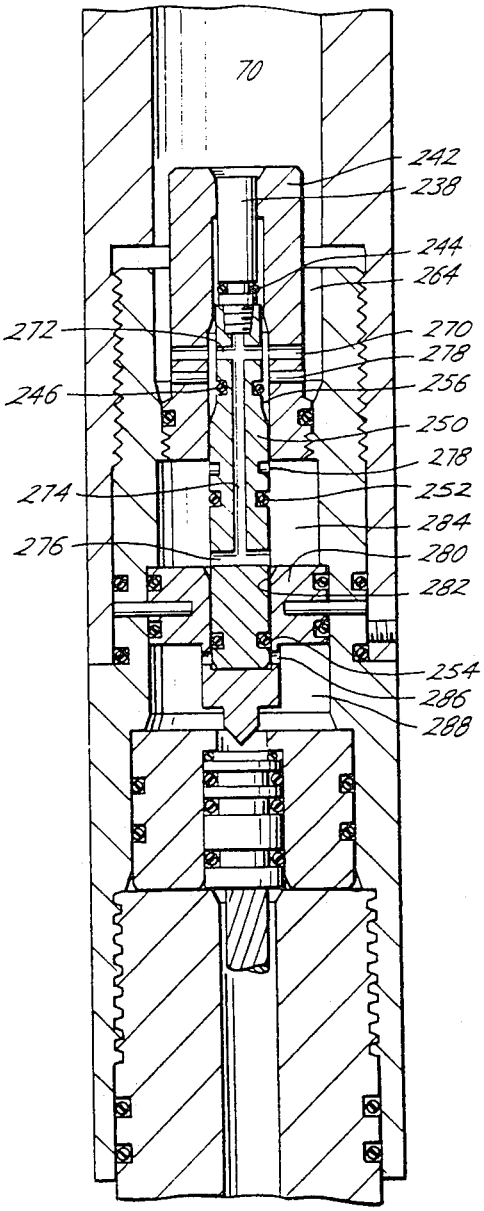
FIG. 7 is an enlarged cross-sectional view of the embodiment of FIG. 5 after partial actuation.

Referring now to FIG. 7 showing partial actuation, shear pin 278 is sheared by increasing the fluid pressure in passageway 70 which, when applied to the cross-sectional area of shaft 238 projecting into passageway 70 and to the remaining cross-sectional area of piston plug 250 in bore 256 via ports 270, the force will reach the predetermined amount which will shear pins 278. As piston plug 250 and shaft 238 move downwardly, the lower end of piston plug 250 with O-ring seal 254 enters piston passageway 282 where O-ring seal 254 sealingly engages piston plug 250 and large piston 280 to close off lateral ports 286 in large piston 280. Then, O-ring seals 244 on shaft 238 and seal ring 246 on the upper end of piston plug 250 move into enlarged bushing bores 248, 256, respectively whereby seals 244, 246 disengage their sealing engagement with bushing 242. Further, as piston plug 250 moves out of bore 256 of bushing 242, O-ring seal 252 also unseals with bushing 242. However, prior to the disengagement of seals 244, 246 and 252, the lower seal 254 on piston plug 250 sealingly engage the cylindrical wall of bore 282 in piston 280 which in turn seals off piston ports 286. When plug 250 bottoms in cylinder 282 of piston 280, radial ports 272 are in communication with ports 270.

As illustrated in FIG. 7, the fluid in passageway 70 is now free to flow around bushing 242 in annulus 264 and through bushing ports 270. Further, the fluid in passageway 70 can flow down bushing bore 240 between shaft 238 and bushing 242. Once the fluid from passageway 70 reaches enlarged bushing bore 256 from either bore 242 or ports 270, the fluid can pass through passageways 272, 274 and 276 in plug 250 into upper chamber 284 or through bushing bore 256 between piston plug 250 and bushing 242 into upper chamber 284.

Figure 8:
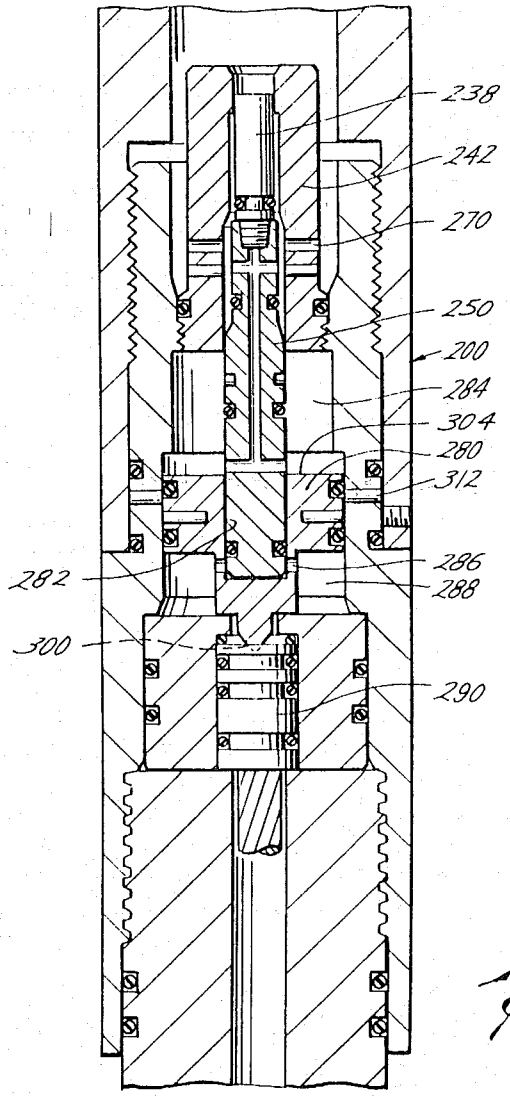
FIG. 8 is an enlarged cross-sectional view of the embodiment of FIG. 5 after full actuation and detonation of the perforating gun.

Referring now to FIG. 8, pressure actuated firing head 200 is shown fully actuated. By unsealing ports 270 and unsealing shaft 238 and piston plug 250 with bushing 242, the fluid pressure from passageway 70 is applied in upper chamber 284. Further, because piston plug 250 has now sealed off piston ports 286, a fluid pressure differential is effected across large piston 280. Upon the application of this increased fluid pressure onto the upper face 304 of piston 280, and the impact of piston plug 250 engaging the bottom of piston bore 282, pins 312 are sheared and piston 380 moves downwardly in lower chamber 288 with firing pin 300 impacting initiator 290 and thereby detonate charges 52 of perforating gun 50. Piston 280 snaps downwardly to provide a substantial impact between firing pin 300 and initiator 290.

Should it be necessary to remove the tool string from the well for some reason such as the failure of the gun to discharge, the packer may be unseated and the tool string raised. An inadvertent activation of the firing head is not of concern. The previously discussed safety features render the firing head safe. The pressure effected on the firing head is reduced as the tubing string is raised and the large piston remains pressure balanced.

The present invention may be used in a variety of applications. FIG. 9 illustrates the use of the present invention in a highly deviated well where a bar-actuated firing head cannot be used because the bar will not travel down the tubing string with enough speed to sufficiently impact a bar actuated firing head. As shown in FIG. 9, casing 16 extends downwardly in the vertical direction and then is turned to a substantially horizontal position. A tool string consisting of a packer 30, vent assembly 56, pressure actuated firing head 60, and jet perforating gun 50 suspended on a tubing string 26 is lowered into casing 16 until gun 50 is adjacent formation 14. Tubing string 26 is filled with a fluid. Packer 30 is set and vent assembly 56 is opened. It should be understood that a perforated nipple may be used rather than a vent assembly. Pump pressure is applied down the flow bore 40 of tubing string 26 to actuate firing head 60 and fire gun 50. The pump pressure is bled off to produce formation 14. In this application, the perforating gun 50 is actuated without the use of a bar.

Figure 10:
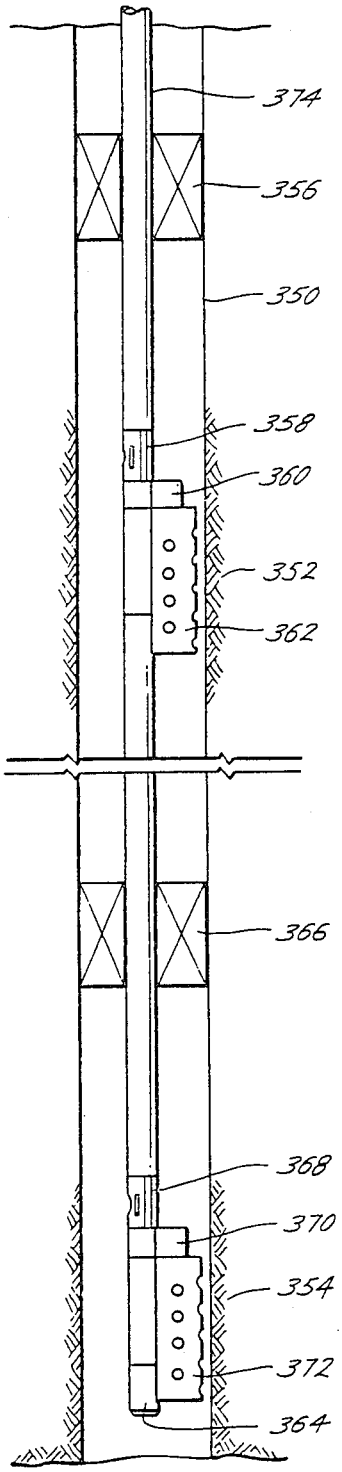
FIG. 10 is a partly schematic, partly diagrammatic view of a well for perforation of multiple portions of the cased borehole using a plurality of apparatus made in accordance with the present invention associated therewith.

Another application of the present invention is illustrated in FIG. 10. In this application the present invention is used to test a plurality of payzones through a single tubing string. Referring to FIG. 10, there is shown a casing 350 extending through a plurality of payzones such as upper payzone 352 and lower payzone 354. The tool string includes an upper packer 356, an upper vent 358, an upper pressure actuated firing head 360, an upper perforating gun 362, a lower packer 366, a lower vent 368, a lower pressure actuated firing head 370, a lower perforating gun 372 and a bull plug 364, all suspended on tubing string 374. Bull plug 370 closes the lower end of tubing string 374. Although only two payzones and corresponding perforating guns are shown, it should be understood that any number of payzones could be tested by adjacent perforating guns mounted on tubing string 374. Upper and lower pressure actuated firing heads 360, 370 and upper and lower perforating guns 362, 372 are mounted on the exterior of tubing string 374. Each pressure actuated firing head is in fluid communication with the tubing flow bore of tubing string 374 by means of a ported connector whereby pressure effected down the tubing flow bore of string 374 is applied to the respective plugs of firing heads 360, 370. Vents 358, 368 may be sliding sleeves or one-way valves for the passage of production fluids into the tubing flow bore of string 374 after perforation. It should be obvious that a bar cannot be used in this situation since the perforating guns are disposed outside the tubing string. The shear pins 188 in firing heads 360, 370 are set at 500 psi intervals whereby the lowest firing head 370 and gun 372 will be actuated first. Thus lower pressure actuated firing head 370 has shear pins 188 set to shear at a predetermined pressure 500 psi lower than the predetermined pressure set to shear the pins 188 in upper pressure actuated firing head 360. In operation, lower packer 366 is set to isolate payzone 354. When the invention is used in a new well such that the annulus below packers 356, 366 can be pressurized, lower vent 368 may be a sliding sleeve which is opened using a wireline prior to perforating. Pressure is then effected down tubing string 374 until shear pins 188 of lower firing head 370 are sheared and gun 372 is detonated. Production is then permitted into tubing string 374 via lower vent 368. After lower payzone 354 is tested, lower vent 368 is closed and upper packer 356 is set if it has not already been set. Upper vent 358 is then opened and pressure is again applied through tubing string 374 until pins 188 in upper firing head 360 are sheared and payzone 352 is perforated for testing. Production is then permitted into tubing string 374 via upper vent 358. Where the annulus below packers 356, 366 cannot be pressurized, as for example where there are existing perforations already in payzones 352, 354, vents 358, 368 may be one-way valves which are opened to the flow of production fluids after perforation either by bleeding the pressure off from tubing string 374 or swabbing string 374 to open the one-way valve.

A still another application of the present invention is with a workover operation where the well has previously been perforated. As shown in FIG. 1, a tool string with a packer 30, vent assembly 56, releasable coupling 58, pressure actuated firing head 60, and jet perforating gun 50 suspended on tubing string 26 is run into the well with the vent assembly 56 closed. Tubing string 26 is filled with fluid. Packer 30 is hydraulically set. Pump pressure is applied down the flow bore 40 of tubing string 26 to actuate firing head 60 and fire gun 50. Vent assembly 56 is then opened, and the pump pressure is bled off or the tubing string is swabbed to bring in the well. Vent assembly 56 could not have been opened prior to detonation due to the old perforations in the payzone. Vent assembly 56 may be a sliding sleeve or a check valve which opens when the pressure in the tubing string is reduced. No underbalance, i.e. downhold pressure less than formation pressure, is used. The same procedure may be used in a new well where an overbalance is desired, i.e. downhole pressure greater than formation pressure. Gun 50 may be dropped by using releasable coupling 58.

In another application, the activation of head 60 is initiated by dropping a bar. Where a bar may be dropped down tubing string 26, a tool string with packer 30, vent assembly 56, firing head 60, and gun 50 suspended on tubing string 26 is run into the well with vent assembly 56 closed. Tubing string 26 is filled with a light fluid such as water creating a hydrostatic head substantially less than the formation pressure so as to create an underbalance. However, the shear pins 188 in the piston plug 160 require a force in excess of the hydrostatic head in the casing annulus 28 plus a safety margin pressure. In order to maintain the underbalance, it is necessary to actuate head 60 without pressuring down the tubing flow bore 40 an amount necessary to shear pins 188 since such a pressure would cause an overbalance situation. Thus, a bar is dropped down the tubing string 26 to open vent assembly 56 and impact head 178 on stem 174 of plug 160 to shear pins 188 and open upper chamber 100A to the hydrostatic head of the fluid in tubing flow bore 40. Although the hydrostatic head in tubing flow bore 40 is insufficient to shear pins 188, it is sufficient, when applied to the larger pressure area of piston 120, to shear pins 150 and actuate head 60. Thus, the bar and hydrostatic head are used in combination to actuate head 60.

In this application, firing head 160 also acts as a fail safe device. If, after dropping the bar, the head does not actuate because, for example, there is debris in the tubing string preventing the bar from having sufficient impact on head 178 to shear pins 188, the operator has a second chance. Rather than attempting to fish out the bar or unseat the packer and remove the tubing string, pump pressure is added to the hydrostatic head in the tubing flow bore 40. Once the pressure in the tubing flow bore 40 reaches the predetermined pressure, pins 188 are sheared and firing head 60 is actuated by pressure. Although the underbalance is lost, the operator is still able to achieve a well completion.

In a variation to the above, the bar initiates activation of the pressure actuated firing head but additional pressure must be added to the tubing flow bore to complete actuation. The tool string is lowered into the well with a normally closed vent assembly. In operation a bar is dropped downhole. The bar opens vent assembly 56 and impacts against head 178, thereby driving the plug 160 into the piston passageway 162 and forming a flow path from the tubing string into the upper chamber 100A. The gun firing head 160 now is the "armed" or "cocked" position and the gun 50 is ready to fire upon the addition of sufficient pressure being effected within the tubing string 26. The vent 56 can be opened using wireline, bar, or packer actuated devices. Further pressure is then applied. This preferably is accomplished using $N_2$, $CO_2$, or flue gases, although a liquid could be employed to elevate the tubing hydrostatic head or fluid pressure to the valve required to shear the piston pin 150. After the pressure differential across the piston 120 has sheared the piston pins 150, the piston 120 strokes downhole, thus forcing firing pin 146 to strike the initiator 90, and explode the prima cord 53, which detonates the individual shaped charges 52. After the casing 16 has been perforated, the tubing is swabbed until production is achieved. In some instances it may be necessary for the well to be put on a pumpjack unit because of the low downhole formation pressure. In the above example, it is, of course, necessary to contain the downhole pressure by the provision of a hydrostatic head achieved by the use of a suitable well fluid.

Those skilled in the art, having digested the above description of this invention, will appreciate that the gun firing head can be actuated by (1) elevated pressure of a predetermined magnitude; (2) bar and pressure combination; or (3) bar and elevated tubing pressure in two distinct steps.

One advantage of the present invention is to fire a perforating gun or guns under conditions which prevent firing with a bar. One such condition would be to pressure the tubing or the annulus to fire a lower gun prior to firing an upper gun with the upper gun and lower gun being attached to one another. The upper gun can thus be fired by dropping a bar. Therefore, the present invention enables the charges of a casing gun to be detonated commencing at the bottom-most charge and proceeding uphole until the uppermost charge has been fired. This may be accomplished by inverting the gun and gun firing head, thereby locating the gun firing head on the bottom of the gun "looking downhole". The vent assembly by the lower gun must be opened in order to fire the lower gun by elevating the bottom hole pressure as in (1) above. A bar cannot be used as in (2) above in this instance.

An unusual feature of this invention lies in the plug, piston and passageways being arranged whereby there is one large apertured piston within which a plug must be sealingly received in order for the head to be detonated. The plug and piston are selectively moved by pressure, impact, or a combination thereof. Leakage of incompressible well fluids into the head is equalized across the piston and thereafter there can be no pressure differential developed thereacross because of the presence of the piston passageway. Leakage of well fluids into the sealed off area is bled off to equalize the leakage pressure on the plug.

In the foregoing, the invention has been described primarily with reference to shape and structure. It can be further described from the standpoint of function.

It is desired to detonate the gun hydraulically (or conceivably by any fluid pressure, including gas). To that end a so called hydraulic cylinder, i.e. a cylinder in which moves a piston, is employed. Since circular cross-section is merely usual but not essential, the cylinder may be referred to as an expansible chamber having a movable wall (the piston).

It is desired to admit pressure fluid to the interior of the expansible chamber to move its movable wall to detonate the gun by means of a firing pin carried by the wall. So an inlet fluid passage is provided through a fixed wall of the expansible chamber and a valve is placed in the inlet. In the present case the small plug 160 and bushing 152 provide such a valve. Radial ports 180 are this valve inlet. The cylindrical surface of piston bore 166 is the valve seat. Large piston 120 is the valve closure. The valve outlet is the lower end of cylinder 164, which discharges into upper chamber 100A when the valve is open, as shown in FIGS. 3, 4 and 7. In FIGS. 2 and 5 this valve is shown in closed position.

Should this primary valve leak and fluid enter the expansible chamber, the movable wall would move the firing pin to detonate this gun in the absence of means provided to prevent such an occurrence. This is the problem faced and solved by this invention.

An equalizing passage is provided through the movable wall communicating the interior of the expansible chamber with the outside of the movable wall. As long as this equalizing passage is open, no differential pressure can build up on opposite sides of the movable wall and the gun will not fire since the movable wall is held fixed by shear pins.

To arm the firing head, the equalizing fluid passage must be closed. This is achieved by means of an auxiliary valve which, in the present case, includes a valve closure provided by the lower end of the small plug 160, such valve closure cooperating with a valve seat provided by the inner periphery of cylinder 162 in the large piston 120.

It will be seen that the two valves are connected together or interlocked so that when the primary or supply valve is closed, the auxiliary or equilizer valve is open, as shown in FIGS. 2 and 5; when the primary or supply valve is open, the auxiliary or equilizer valve is closed, as shown in FIGS. 3, 4 and 7. Furthermore, the seal spacing, referring to seals 182 and 184, is such that the auxiliary valve (seal 134) closes before the primary valve (seals 182) opens, so that opening of the primary or supply valve will not admit fluid to the outside of the expansible chamber (below the big piston) and hydraulically lock the firing head.

Recapitulating, according to the invention a perforating gun firing head comprises a pipe nipple to be connected at its lower end to a gun and and at its upper end to a pipe string. The nipple has a transverse wall at its upper end and a detonator mounted in its lower end. A piston is secured in the nipple between its ends by lower shear pins. The piston carries a firing pin on its lower side and has a pressure equalizing fluid passage from its upper side to its lower side. The transverse wall has a fluid supply passage from its upper side to its lower side to admit pressure fluid from the pipe string to the upper side of the piston. A valve in the fluid supply passage includes a plunger normally closing the supply passage and held in closed position by upper shear pins, the lower end of the plunger moving to close the pressure equalizing passage when the upper shear pins are sheared and the plunger moves to open the fluid supply passage to admit pressure fluid to the upper side of the piston. The plunger is moved down and the upper shear pins sheared either by pressure on an area of the plunger or by a hammer blow on an anvil connected by a stem to the upper end of the plunger. Another area around the plunger below the stem is sealed off from pressure fluid and passages in the plunger equalize pressure between the sealed area and the lower end of the piston.

It is to be understood that although it is preferred that the upper shear pins break at a higher pressure than the lower shear pins, as that operation without the use of a bar, i.e. all pressure operation, will cause a snap action of the firing head, it would also be possible to provide a firing head in which the upper shear pins sheared at a lower tubing pressure than the lower shear pins, thereby a two stage all pressure operation could be achieved, the head first being armed by raising the tubing pressure to a certain value to shear the upper shear pins and thereafter at any time the pressure could be raised to a higher pressure sufficient to shear the lower shear pins and move the lower piston to detonate the gun.

It would also be possible to provide that the upper and lower shear pins both shear at the same pressure.

While a preferred embodiment of the invention has been shown and described, modifications thereof can be made by one skilled in the art without departing from the spirit of the invention.

I claim:

1. Method of firing a perforating gun which is suspended within a well on the end of a pipe string, comprising the steps of:

(1) communicating a fluid flow path from the surface to a firing head adjacent the perforating gun;

(2) effecting a predetermined pressure through the fluid flow path to the firing head;

(3) closing a passageway through a movable wall reciprocally mounted in a chamber within the firing head in response to the predetermined pressure of step (2);

(4) opening a valve in the fluid flow path for fluid communication with one side of the movable wall in the chamber in response to the predetermined pressure of step (2);

(5) effecting the predetermined pressure on the one side of the movable wall to cause the movable wall to move; and (6) using the movement of the movable wall of step (5) for detonating the charges of the perforating gun.

2. Method of firing a perforating gun which is suspended downhole in a borehole on the end of a tubing string, wherein the gun includes shaped charges which are connected to an initiator so that the initiator can be activated to detonate the charges, comprising the steps of:

(1) elevating the tubing pressure to a first downhole pressure value;

(2) moving a first member in response to the pressure value of step (1);

(3) using the member movement of step (2) for closing a passageway which extends into a piston;

(4) effecting the pressure value of step (1) on one side of the piston to cause the piston to move;

(5) using the movement of the piston set forth in step (4) for activating the initiator and thereby detonating the charges of the gun.

3. The method of claim 2 wherein there is further included the steps of:

forming a first chamber bore and a second chamber below the piston; and, conducting well fluid which may inadvertently leak into the gun into the first chamber, through the piston, and into the second chamber to thereby preclude a pressure differential across the piston.

4. Method of detonating a perforating gun located on a pipe string and positioned downhole in a borehole, comprising the steps of:

(1) arranging the perforating gun in a manner to be detonated by an initiator;

(2) placing a first and a second piston, respectively, in spaced relationship within a first and a second cylinder, respectively;

(3) positioning the initiator, first and second pistons, first and second cylinders to form a first chamber between the initiator and the first piston, and to form a second chamber between the first piston and the second cylinder;

(4) forming a passageway along the axial centerline of the first piston into which one end of the second piston can be sealingly received;

(5) forming a flow path which extends from the interior of the tubing string, into the second cylinder, and into the second chamber when the second piston is sealingly reciprocated into the passageway of the first piston, thereby providing a means by which an increased pressure effected within the tubing string also effects a pressure differential across the first piston, thereby driving the first piston downwardly and exploding the initiator.

5. The method of claim 4 and further including the steps of:

arranging the first and second pistons, the first and second cylinders, the first and second chambers, and the initiator along a common axial centerline and within a common body.

6. The method of claim 4, and further including the steps of extending the second piston upwardly into the flow path which is in communication with the interior of the tubing; and, impacting one end of the second piston with sufficient force to move the second piston into sealed relationship with the passageway so that pressure subsequently effected within the tubing string also provides a pressure differential across the first piston.

7. The method of claim 4, said passageway extends from the second chamber, through the first piston, and into the first chamber so that inadvertent leakage of incompressible well fluids into the second chamber provides a fluid on the opposed sides of the first piston and prevents the first piston from moving.

8. The method of claim 7 and further including the steps of:

extending the upper end of the second piston upwardly into an area which is in communication with the interior of the tubing; and, running a mass downhole through the tubing string and impacting one end of the second piston to move the second piston into sealed relationship with the passageway so that pressure subsequently effected within the tubing string also provides a pressure differential across the first piston.

9. The method of claim 4 and further including the steps of:

arranging a port through the second piston;

receiving the second piston in the second cylinder prior to effecting the pressure differential across the first piston;

sealing the port to fluid flow from the flow path when the second piston is received in the second cylinder;

communicating the flow path with the second chamber through the port upon the second piston reciprocating into the passageway of the first piston.

10. The method of claim 4 and further including the steps of:

forming a port through the second piston;

receiving the second piston is the second cylinder prior to effecting the pressure differential across the first piston;

conducting well fluid which may inadvertently leak between the second piston and cylinder through the port and into the second chamber to preclude a premature reciprocation of the second piston in the second cylinder.

11. Method of perforating a highly deviated well comprising the steps of:

suspending a perforating gun on a pipe string extending down into the highly deviated well;

setting a packer disposed on the pipe string above the perforating gun;

communicating a fluid flow path from the surface to a firing head adjacent the perforating gun;

effecting a predetermined pressure through the flow path to the firing head;

opening a valve in the flow path for fluid communication with one side of a movable member reciprocally disposed in a chamber in the firing head in response to the predetermined pressure;

effecting the predetermined pressure on the one side of the movable member to cause the movable member to move; and using the movement of the movable member to actuate the perforating gun.

12. The method of claim 11 further including the steps of:

forming the fluid flow path in the flow bore of the pipe string and filling the pipe string with a fluid prior to detonation of the gun.

13. The method of claim 12 further including the steps of:

opening the pipe string at a point below the packer to the flow of hydrocarbons from the well formation;

reducing the predetermined pressure in the flow path; and flowing hydrocarbons from the formation and through the flow bore of the pipe string to the surface.

14. Method of testing a formation in a well comprising the steps of:

mounting a first perforating gun and firing head on a pipe string;

mounting a second perforating gun and firing head on the pipe string;

running the pipe string into the well;

setting a packer disposed on the pipe string above the first perforating gun;

communicating the firing head of the first perforating gun with a fluid flow path to the surface;

locating the first perforating gun adjacent a first formation to be tested;

effecting a predetermined pressure through the flow path to the firing head of the first perforating gun;

effecting the predetermined pressure on one side of a movable member reciprocably disposed in a chamber in the firing head of the first perforating gun to cause the movable member to move;

using the movement of the movable member to actuate the first perforating gun and communicate the first formation with the wellbore;

testing a parameter of the first formation;

setting another packer to isolate the first formation from a second formation in the well;

communicating the firing head of the second perforating gun with the fluid flow path to the surface;

effecting another predetermined pressure greater than the first mentioned predetermined pressure through the flow path to the firing head of the second perforating gun;

effecting the another predetermined pressure on one side of the movable member reciprocably disposed in a chamber in the firing head of the second perforating gun to cause the movable member to move;

using the movement of the movable member to actuate the second perforating gun and communicate the second formation with the wellbore; and testing a parameter of the second formation.

15. The method of claim 14 further including the steps of:

forming the fluid flow path in the flow bore of the pipe string and communicating the firing heads with the flow bore; and filling the pipe string with a fluid prior to detonation of the gun.

16. The method of claim 15 further including the steps of:

opening the pipe string at points below the packers to the flow of hydrocarbons from the formations to be tested.

17. Method of firing a perforating gun which is suspended within a well on a pipe string, comprising the steps of:

communicating a flow path from the surface to a firing head adjacent the perforating gun;

filling the flow path with a fluid;

effecting a predetermined pressure through the flow path to the firing head;

lowering a mass through the pipe string to close a passageway through a moveable wall reciprocably mounted in a chamber within the firing head and to open a valve in the flow path for fluid communication with one side of the movable wall in the chamber;

effecting the predetermined pressure on the one side of the movable wall to cause the movable wall to move; and using the movement of the movable wall for detonating the charges of the perforating gun.

18. The method of claim 17 and further including the steps of:

raising the pressure down the flow path to a level above the predetermined pressure in case the mass fails to close the passageway or open the valve;

effecting the additional pressure onto a piston member in the valve;

moving the piston member to open the valve; and effecting the additional pressure and predetermined pressure on the one side of the movable member.

* * * * *